US009378687B2

(12) United States Patent
Tamaki et al.

(10) Patent No.: US 9,378,687 B2
(45) Date of Patent: Jun. 28, 2016

(54) DISPLAY APPARATUS AND ELECTRONIC APPARATUS INCLUDING SUB PIXELS HAVING DIFFERENT AREAS

(71) Applicant: Japan Display Inc., Tokyo (JP)

(72) Inventors: Masaya Tamaki, Kanagawa (JP); Tatsuya Yata, Kanagawa (JP)

(73) Assignee: Japan Display Inc., Tokyo (JP)

( * ) Notice: Subject to any disclaimer, the term of this patent is extended or adjusted under 35 U.S.C. 154(b) by 325 days.

(21) Appl. No.: 13/741,906

(22) Filed: Jan. 15, 2013

(65) Prior Publication Data

US 2013/0235060 A1 Sep. 12, 2013

(30) Foreign Application Priority Data

Mar. 9, 2012 (JP) ..... 2012-052400

(51) Int. Cl.
*G09G 5/00* (2006.01)
*G09G 3/36* (2006.01)
*G09G 3/20* (2006.01)

(52) U.S. Cl.
CPC ..... *G09G 3/36* (2013.01); *G09G 3/207* (2013.01); *G09G 3/3607* (2013.01); *G09G 3/3648* (2013.01); *G09G 2300/0857* (2013.01)

(58) Field of Classification Search
CPC ..... G09G 2300/0842; G09G 2300/0426
USPC ..... 345/206
See application file for complete search history.

(56) References Cited

U.S. PATENT DOCUMENTS

| | | | | |
|---|---|---|---|---|
| 6,100,861 | A * | 8/2000 | Cohen et al. | 345/88 |
| 6,781,153 | B2 * | 8/2004 | Anzai | 257/59 |
| 2010/0001946 | A1 | 1/2010 | Murayama et al. | |
| 2011/0187953 | A1 * | 8/2011 | Hiyama et al. | 349/42 |
| 2011/0233528 | A1 | 9/2011 | Levermore et al. | |
| 2012/0139967 | A1 * | 6/2012 | Miyasaka et al. | 345/690 |

FOREIGN PATENT DOCUMENTS

| | | |
|---|---|---|
| JP | 08-084347 | 3/1996 |
| JP | 08-304761 | 11/1996 |
| JP | 2003-302946 | 10/2003 |
| JP | 2006-039290 | 2/2006 |
| JP | 2007-093845 | 4/2007 |
| JP | 2007-140456 | 6/2007 |
| JP | 2007-226202 | 9/2007 |
| TW | 201003631 | 1/2010 |
| TW | 201203646 | 1/2012 |

OTHER PUBLICATIONS

Office Action issued in connection with Taiwanese Patent Application No. 101142494, dated Sep. 10, 2014. (10 pages).

(Continued)

*Primary Examiner* — Ram Mistry
(74) *Attorney, Agent, or Firm* — K&L Gates LLP

(57) ABSTRACT

A display apparatus includes: a plurality of sub pixels that are included in a single pixel, that respectively perform a predetermined display based on a voltage which is supplied using a first electrode and a second electrode and display colors which are different from each other, wherein the plurality of sub pixels include areas which are different from each other, and respectively include pixels which have memory properties.

5 Claims, 10 Drawing Sheets

(56) References Cited

OTHER PUBLICATIONS

Japanese Office Action issued Feb. 20, 2015 in corresponding Japanese Application No. 2012-052400.
Japanese Office Action issued Jul. 28, 2015 in corresponding Japanese Application No. 2012-052400.

* cited by examiner

DISPLAY APPARATUS AND ELECTRONIC APPARATUS INCLUDING SUB PIXELS HAVING DIFFERENT AREAS

CROSS REFERENCES TO RELATED APPLICATIONS

The present application claims priority to Japanese Priority Patent Application JP 2012-052400 filed in the Japan Patent Office on Mar. 9, 2012, the entire content of which is hereby incorporated by reference.

BACKGROUND

The present disclosure relates to a display apparatus which displays an image, and an electronic apparatus.

For example, in a liquid crystal display apparatus, a single pixel includes a plurality of sub pixels which display colors which are different from each other. The types of colors which are displayed using the sub pixels are, for example, red (R), green (G), blue (B), and the like. In each of the sub pixels, a pixel electrode and a common electrode are arranged. Each of the sub pixels performs a predetermined display based on a voltage which is supplied using the pixel electrode and the common electrode based on display data.

From among such display apparatuses, there is a display apparatus which differentiates, for example, the areas of the sub pixels from each other in order to adjust white color. A pixel which includes such sub pixels is called, for example, an atypical pixel.

JP-A-8-84347 is an example of the related art.

SUMMARY

In a case of the atypical pixel, the areas of the pixel electrodes are different from each other between sub pixels. Therefore, the capacity between the pixel electrode and the common electrode differs in the sub pixels.

Meanwhile, in the display apparatus, when an electric potential is supplied to the pixel electrode, a switch device, such as a Thin Film Transistor (TFT), which is arranged between the pixel electrode and a signal line, is turned on, the pixel electrode is charged with electric charges. Thereafter, the switch device is turned off, thus the pixel electrode is electrically separated from the signal line, thereby entering a floating state.

At this time, although it is necessary to uniformly maintain the electric potential of the pixel electrode during a predetermined time (for example, a write time of display data of 1 frame), there may be a case in which the electric potential of the pixel electrode varies because of leakage attributable to the switch device or parasitic capacitance between the pixel electrode and a peripheral wiring. In this case, there may be a possibility of generating inferior image quality, such as flicker or stripes.

In contrast, there is a method of reducing variation in electric potential of the pixel electrode by adding an accumulation capacitor, a method of adjusting the electric potential of the common electrode, allowing integration voltages that are equivalent before and after polarity reversion, and causing flicker not to be viewed, or the like. However, like the atypical pixel, when the capacitance between the pixel electrode and the common electrode differs between sub pixels, the adjustment becomes more complicated and difficult.

It is therefore desirable to provide a display apparatus and an electronic apparatus which improve the image quality of the display apparatus which includes atypical pixels.

An embodiment of the present disclosure is directed to a display apparatus, including a plurality of sub pixels that are included in a single pixel, that respectively perform predetermined displays based on a voltage which is supplied using a first electrode and a second electrode and display colors which are different from each other. The plurality of sub pixels may include areas which are different from each other, and respectively include pixels which have memory properties.

Another embodiment of the present disclosure is directed to an electronic apparatus including a display apparatus that displays an image. The display apparatus may include a plurality of sub pixels that are included in a single pixel, that respectively perform predetermined displays based on a voltage which is supplied using a first electrode and a second electrode and display colors which are different from each other. The plurality of sub pixels may include areas which are different from each other, and respectively include pixels which have memory properties.

According to the display apparatus and the electronic apparatus according to the embodiments of the present disclosure, it is possible to improve the image quality of the display apparatus which includes atypical pixels.

Additional features and advantages are described herein, and will be apparent from the following Detailed Description and the figures.

DETAILED DESCRIPTION

Hereinafter, embodiments will be described with reference to the accompanying drawings.

First Embodiment

Figure 1A:
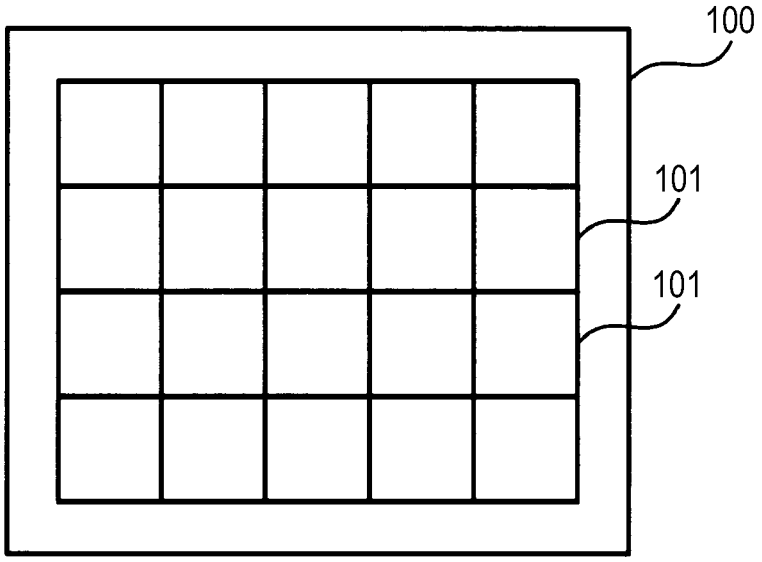
FIGS. 1A and 1B are views illustrating an example of a liquid crystal display apparatus according to a first embodiment.
Figure 1B:
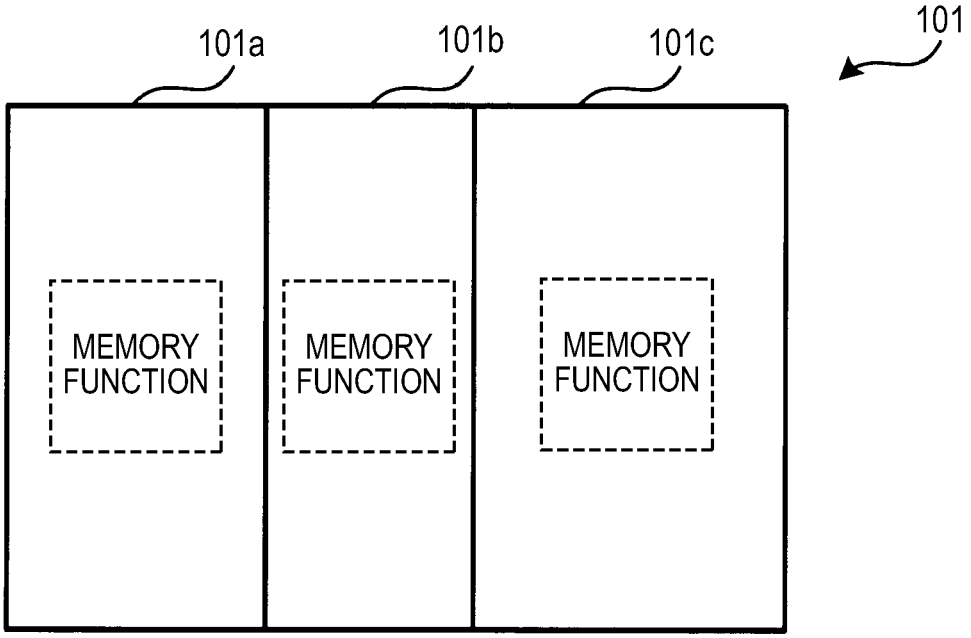

FIGS. 1A and 1B are views illustrating an example of a liquid crystal display apparatus according to a first embodiment. FIG. 1A is a plan view illustrating an example of a liquid crystal display apparatus 100, and FIG. 1B is a plan view illustrating an example of a pixel 101.

As shown in FIG. 1A, the liquid crystal display apparatus 100 includes a plurality of pixels 101 which are formed in a matrix. Such a pixel 101 displays a predetermined color. The pixel 101 is called "pixel".

Further, as shown in FIG. 1B, the pixel 101 includes a plurality of sub pixels 101*a* to 101*c*. The plurality of sub pixels 101*a* to 101*c* display colors which are different from each other. Here, the sub pixel 101*a* displays red (R), the sub pixel 101*b* displays green (G), and sub pixel 101*c* displays blue (B). In addition, the number of sub pixels is not limited to three, and sub pixels which display colors, for example, white (W), yellow (Y), cyan (C), and the like may be added.

In addition, the sub pixels 101*a* to 101*c* include areas which are different from each other. Here, the magnitude relationship between the areas is that the sub pixel 101*c*>the sub pixel 101*a*>the sub pixel 101*b*. As described above, the pixel 101 which includes the sub pixels 101*a* to 101*c* having areas which are different from each other is called, for example, an atypical pixel. As described above, the areas of the sub pixels 101*a* to 101*c* are differentiated from each other, thus it is possible to adjust white color.

Figure 2:
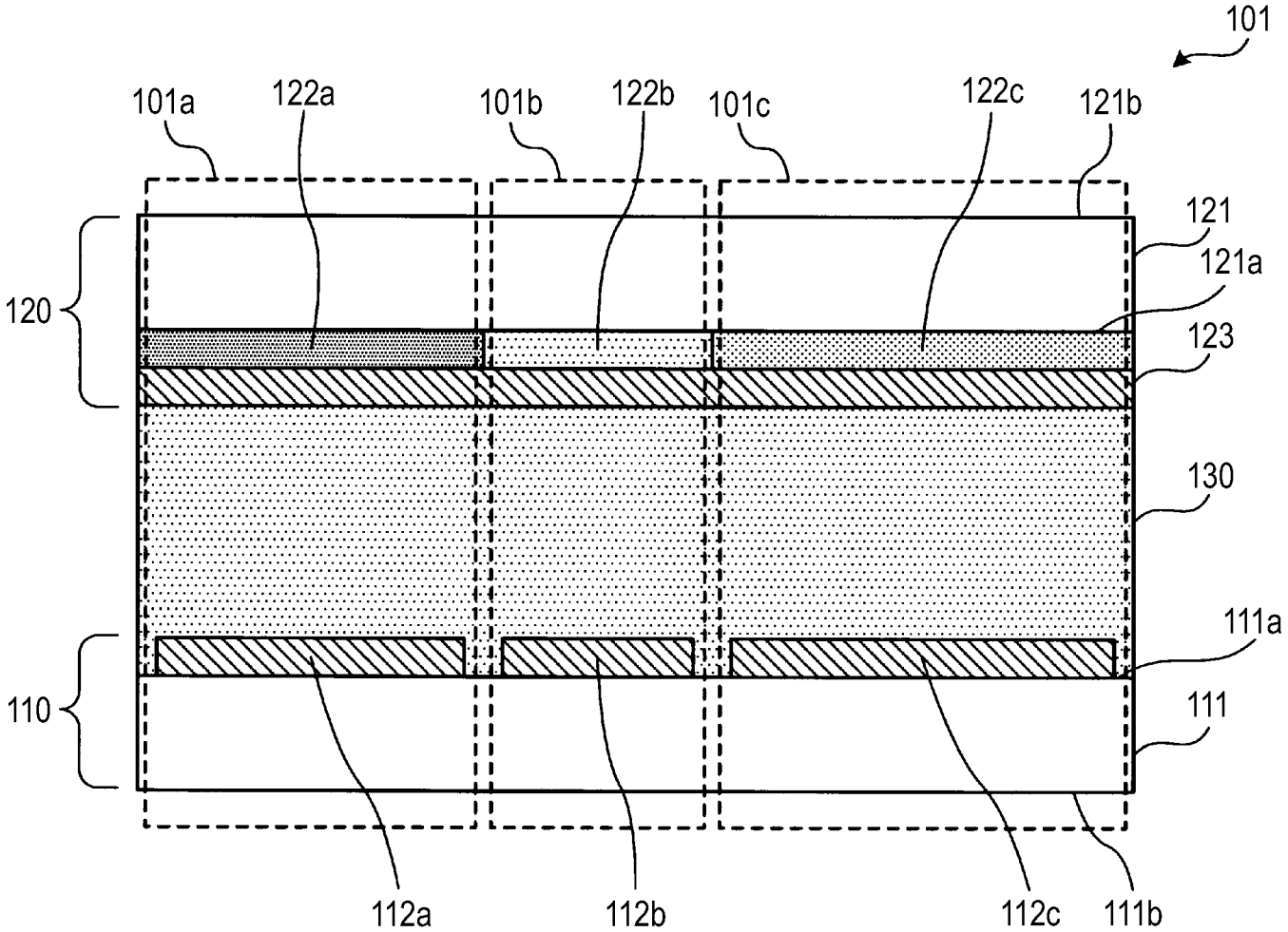
FIG. 2 is a cross-sectional view illustrating an example of a pixel according to the first embodiment.

FIG. 2 is a cross-sectional view illustrating an example of the pixel according to the first embodiment.

The pixel 101 includes an array substrate 110, a counter substrate 120, and a liquid crystal layer 130. In addition, in the pixel 101, pixel electrodes 112*a* to 112*c* are formed on the side of the array substrate 110, and a common electrode 123 is formed on the side of the counter substrate 120. However, the common electrode 123 may be formed on the side of the array substrate 110.

The array substrate 110 includes a transparent substrate 111 which has a surface 111*a* and a surface 111*b* provided on an opposite side to the surface 111*a*. For example, a glass substrate is used for the transparent substrate 111. The pixel electrodes 112*a* to 112*c* are formed on the surface 111*a*.

The pixel electrode 112*a* is arranged in the sub pixel 101*a*, the pixel electrode 112*b* is arranged in the sub pixel 101*b*, and the pixel electrode 112*c* is arranged in the sub pixel 101*c*. A metal which has reflectability, for example, silver (Ag) is used for the pixel electrodes 112*a* to 112*c*.

The counter substrate 120 includes a transparent substrate 121 which has a surface 121*a* and a surface 121*b* provided on an opposite side to the surface 121*a*. For example, a glass substrate is used for the transparent substrate 121. The transparent substrate 121 includes the surface 121*a* which is arranged to face the surface 111*a* of the transparent substrate 111.

Color filters 122*a* to 122*c* are formed on the surface 121*a*. For example, the color filter 122*a* is a red color filter, the color filter 122*b* is green color filter, and the color filter 122*c* is a blue color filter.

Here, the pixel 101 is divided into the sub pixels 101*a* to 101*c* along, for example, the boundaries of the color filters 122*a* to 122*c*. That is, a section at which the color filter 122*a* is arranged is the sub pixel 101*a*, a section at which the color filter 122*b* is arranged is the sub pixel 101*b*, and a section at which the color filter 122*c* is arranged is the sub pixel 101*c*.

Further, the common electrode 123 is formed on the color filters 122*a* to 122*c*. A transparent electrode, for example, Indium Tin Oxide (ITO), Indium Zinc Oxide (IZO), or the like is used for the common electrode 123.

Further, the liquid crystal layer 130 is formed between the array substrate 110 and the counter substrate 120. In the pixel 101, a voltage based on display data is supplied to the liquid crystal layer 130 for each of the sub pixels 101*a* to 101*c* using each of the pixel electrodes 112*a* to 112*c* and the common electrode 123. Therefore, at each of the sub pixels 101*a* to 101*c*, the orientation of the liquid crystal molecules of the liquid crystal layer 130 varies based on the supplied voltage.

In this state, light which is incident from the side of the surface 121*b* of the transparent substrate 121 reflects on the pixel electrodes 112*a* to 112*c*, and the reflected light exits to the side of the surface 121*b* via the liquid crystal layer 130, thus predetermined color is displayed on the side of the surface 121*b*. That is, the pixel 101 is a reflection display-type pixel.

Subsequently, a configuration of the array substrate 110 side of the sub pixels will be described in detail. Here, the sub pixel 101*a* will be described as a representative of the sub pixels 101*a* to 101*c*. In addition, the sub pixels 101*b* and 101*c* have the same configuration as the sub pixel 101*a*.

Figure 3:
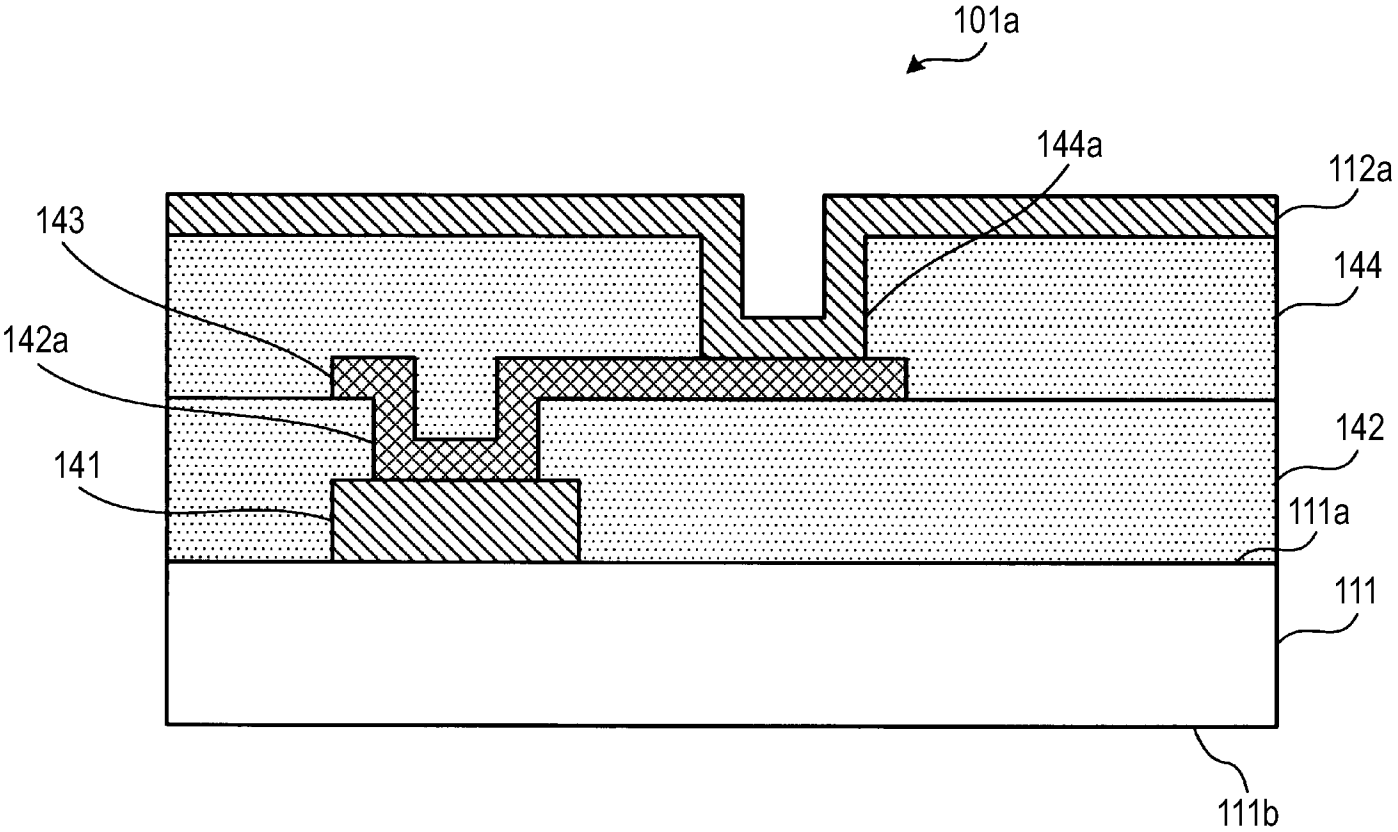
FIG. 3 is a cross-sectional view illustrating an example of a sub pixel according to the first embodiment.

FIG. 3 is a cross-sectional view illustrating an example of the sub pixel according to the first embodiment.

In the sub pixel 101*a*, wiring 141 which supplies electric potential to the pixel electrode 112*a* is formed on the surface 111*a* of the transparent substrate 111. For example, titanium (Ti), aluminum (Al), and a laminated film, in which titanium is laminated in order, are used in the wiring 141.

In addition, an insulation film 142 is formed on the surface 111*a* and covers the wiring 141. The insulation film 142 functions as a planarization film. A contact hole 142*a* which exposes a part of the wiring 141 is provided in the insulation film 142.

Relay wiring 143 is formed on the insulation film 142. One end of the relay wiring 143 is connected to the wiring 141 via the contact hole 142*a*, and the other end extends in the direction away from the contact hole 142*a*. An ITO film is used as the relay wiring 143.

In addition, an insulation film 144 is formed on the insulation film 142 and covers the relay wiring 143. The insulation film 144 functions as the planarization film. A contact hole 144*a* which exposes a part of the relay wiring 143 is provided on the insulation film 144.

Further, the pixel electrode 112*a* is formed on the insulation film 144. The pixel electrode 112*a* is connected to the relay wiring 143 via the contact hole 144*a*. That is, the pixel electrode 112*a* is electrically connected to the wiring 141 via the contact hole 144*a*, the relay wiring 143, and the contact hole 142*a*.

As described above, since the relay wiring 143 is formed, it is possible to set the location of the contact hole 144*a* to a location which is apart from the wiring 141. Therefore, it is possible to improve the degree of freedom of the arrangement of the contact hole 144*a*.

Here, in the first embodiment, as shown in FIG. 1B, each of the sub pixels 101*a* to 101*c* includes a pixel which has a memory property (memory property pixel). The memory property pixel is a pixel which has a function of storing display data. As the memory property pixel, there is, for example, a Memory In Pixel (MIP) type, an electronic paper type, a ferroelectric liquid crystal type, or the like.

In a case in which the sub pixels 101*a* to 101*c* are configured with MIP-type memory property pixels, a pixel circuit which includes a storage circuit on the surface 111*a* of the transparent substrate 111 is formed in each of the sub pixels 101*a* to 101*c*, and the display data is stored in the storage circuit. In addition, electric potential based on the display data which is stored in the storage circuit is supplied to the pixel electrodes using the pixel circuit. Therefore, it is possible to suppress the variation in the electrical potential of the pixel electrodes.

Further, in a case in which the sub pixels 101*a* to 101*c* are configured with electronic paper-type memory property pixels, for example, cholesteric liquid crystal is used for the liquid crystal layer 130. In this case, the orientation of the liquid crystal molecules of the liquid crystal layer 130 is maintained even after the voltage supply to the liquid crystal layer 130 stops. That is, the display data is stored based on the state of the orientation of the liquid crystal molecules of the liquid crystal layer 130. Therefore, it is possible to maintain the display state of the sub pixels 101*a* to 101*c* even when the electric potential of the pixel electrodes varies.

In addition, in a case in which the sub pixels 101*a* to 101*c* are configured with ferroelectric liquid crystal-type memory property pixels, ferroelectric liquid crystal is used for the liquid crystal layer 130. In this case, the orientation of the liquid crystal molecules of the liquid crystal layer 130 is maintained even after the voltage supply to the liquid crystal layer 130 stops. That is, the display data is stored based on the state of the orientation of the liquid crystal molecules of the liquid crystal layer 130. Therefore, it is possible to maintain the display state even when the electric potential of the pixel electrodes of the sub pixels 101*a* to 101*c* varies.

Subsequently, the case in which the sub pixels 101*a* to 101*c* are configured with the MIP-type memory property pixels will be described in detail.

Figure 4:
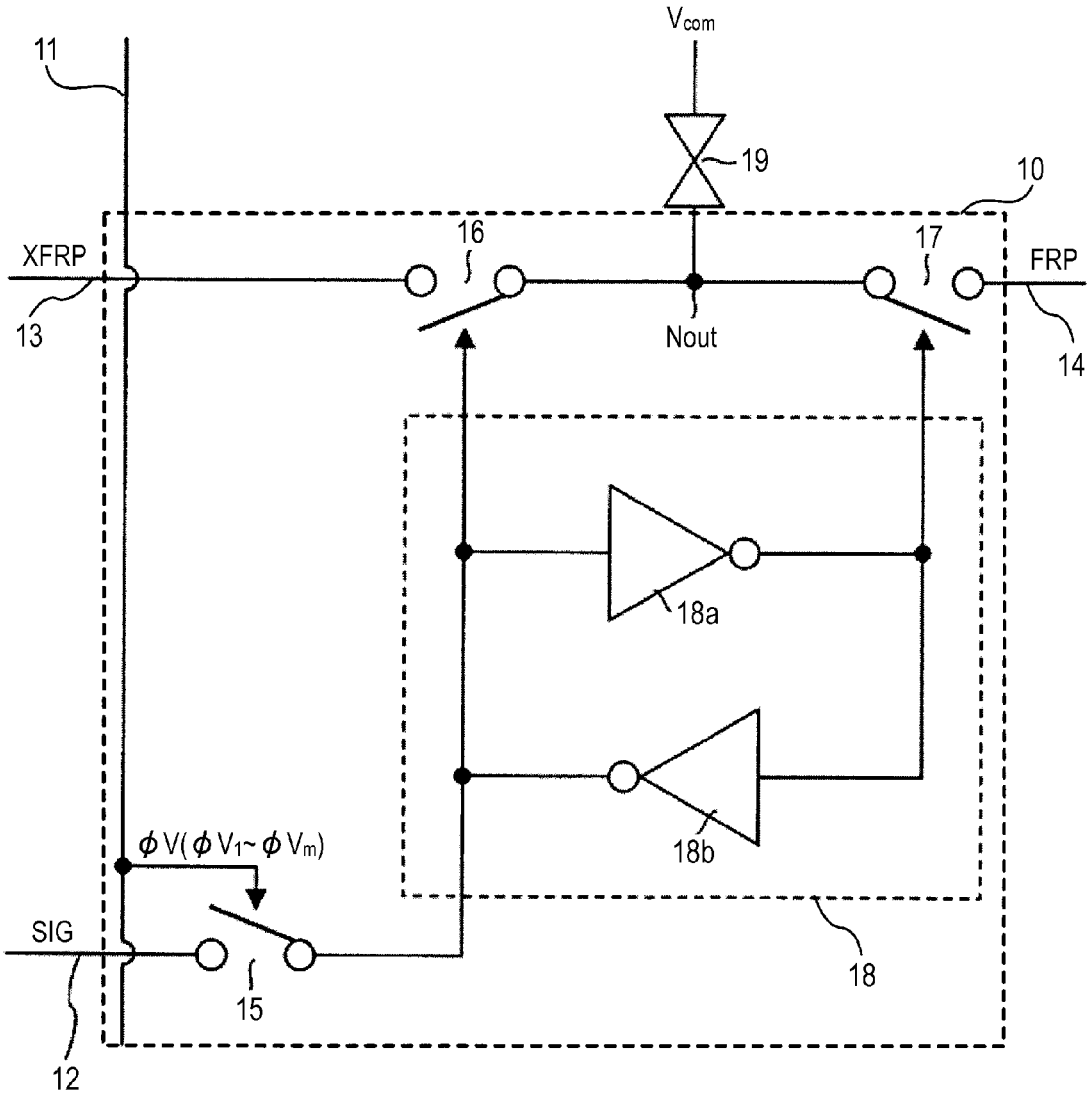
FIG. 4 is a view illustrating an example of the pixel circuit of the sub pixel according to the first embodiment.

FIG. 4 is a view illustrating an example of the pixel circuit of the sub pixel according to the first embodiment.

In the case in which the sub pixels 101*a* to 101*c* are configured with the MIP-type memory property pixels, a pixel circuit 10 is formed in each of the sub pixels 101*a* to 101*c*. The pixel circuit 10 is formed on, for example, the surface 111*a* of the transparent substrate 111.

The pixel circuit 10 is a SRAM function-attached circuit which includes a scan line 11, a signal line 12, electric potential lines 13 and 14, switch devices 15 to 17, a latch circuit 18, and an output node Nout (pixel electrode). In addition, a liquid crystal capacity 19 displays the capacitance between the pixel electrode and the common electrode. Common electric potential Vcom is supplied to the common electrode.

A scan signal ϕV (ϕV1 to ϕVm) is supplied to the scan line 11 from a drive circuit (not shown). The display data SIG is supplied to the signal line 12 from a drive circuit (not shown). A control pulse XFRP, the phase of which is reversed compared to that of the common electric potential Vcom, is supplied to the electric potential line 13. A control pulse FRP, the phase of which is the same as that of the common electric potential Vcom, is supplied to the electric potential line 14.

The switch device 15 is connected between the signal line 12 and the latch circuit 18, and controls the conduction state between the signal line 12 and the latch circuit 18 in response to the scan signal ϕV (ϕV1 to ϕVm) which is supplied to the scan line 11. For example, when the switch device 15 is turned on, the display data SIG is supplied to the latch circuit 18.

The latch circuit 18 includes inverters 18*a* and 18*b* which are inversely connected in parallel, and maintains electric potential based on the display data SIG which is supplied via the switch device 15.

The switch device 16 is connected between the electric potential line 13 and the output node Nout, and controls the conduction state between the electric potential line 13 and the output node Nout based on the polarity of the electric potential maintained using the latch circuit 18. For example, when the switch device 16 is turned on, the control pulse XFRP is supplied to the output node Nout.

The switch device 17 is connected between the electric potential line 14 and the output node Nout, and controls the conduction state between the electric potential line 14 and the output node Nout based on the polarity of the electric potential maintained using the latch circuit 18. For example, when the switch device 17 is turned on, the control pulse FRP is supplied to the output node Nout. Here, only either one of the switch devices 16 and 17 is turned on.

In the pixel circuit 10, when the electric potential maintained using the latch circuit 18 has negative polarity, the switch device 17 is turned on, and the control pulse FRP is supplied to the output node Nout, thus the electric potential of the pixel electrode has the same phase as the common electric potential Vcom. In addition, when the electric potential maintained using the latch circuit 18 has positive polarity, the switch device 16 is turned on, and the control pulse XFRP is supplied to the output node Nout, thus the electric potential of the pixel electrode has a phase which is reversed compared to that of the common electric potential Vcom.

As described above, in the pixel circuit 10, even after the switch device 15 is turned off, the electric potential is maintained using the latch circuit 18 based on the display data SIG, thus one of the control pulses FRP and XFRP is supplied to the pixel electrode based on the maintained electric potential. According to this configuration, it is possible to suppress the variation in the electric potential of the pixel electrode after the switch device 15 is turned off.

As described above, according to the liquid crystal display apparatus 100, each of the sub pixels 101*a* to 101*c* is configured with a pixel which has memory properties. According to this configuration, it is possible to suppress the variation in the electric potential of the pixel electrode, and it is possible to maintain the display state of each of the sub pixels 101*a* to 101*c* even when the electric potential of the pixel electrode varies. Therefore, in the sub pixels 101*a* to 101*c*, it is possible to suppress the generation of stripes and flicker without adjusting the capacity between the pixel electrode and the common electrode.

However, for example, when the sub pixels 101*a* to 101*c* are configured with the MIP-type memory property pixels, the pixel circuit 10 is arranged on the surface 111*a* of the transparent substrate 111. At this time, since a plurality of the wiring or transistors, which are included in the pixel circuit 10, are arranged on the surface 111*a*, the layout of the wiring is limited, thus there is a possibility that the contact units of the respective wiring which supplies electric potential to the respective pixel electrodes 112*a* to 112*c* cannot be arranged at predetermined locations.

Figure 5A:
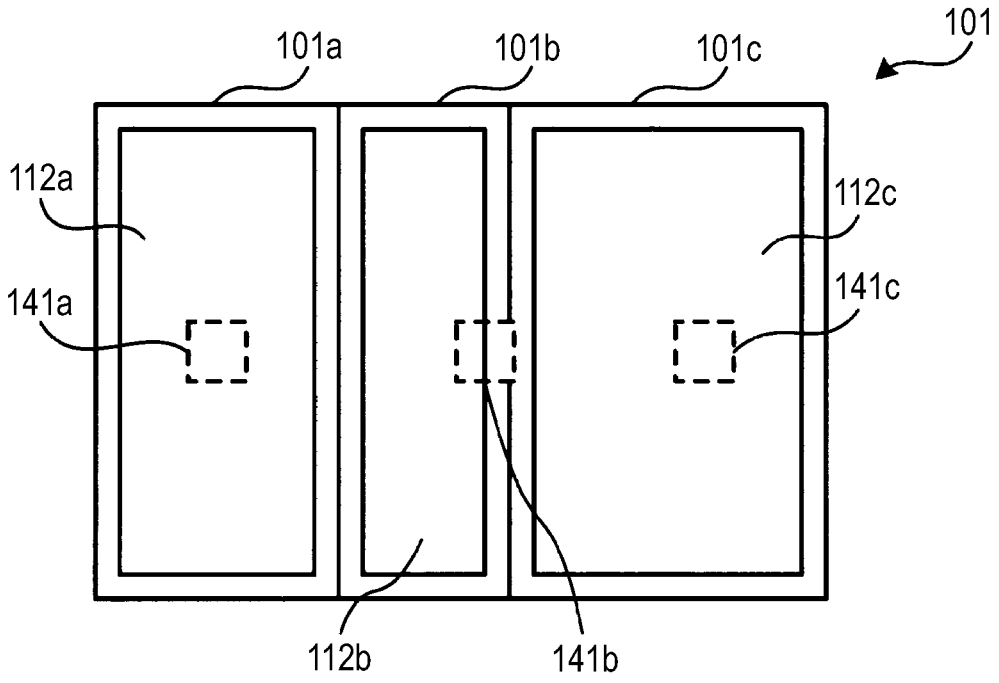
FIGS. 5A and 5B are views illustrating an example of the arrangement of contact units according to the first embodiment.
Figure 5B:
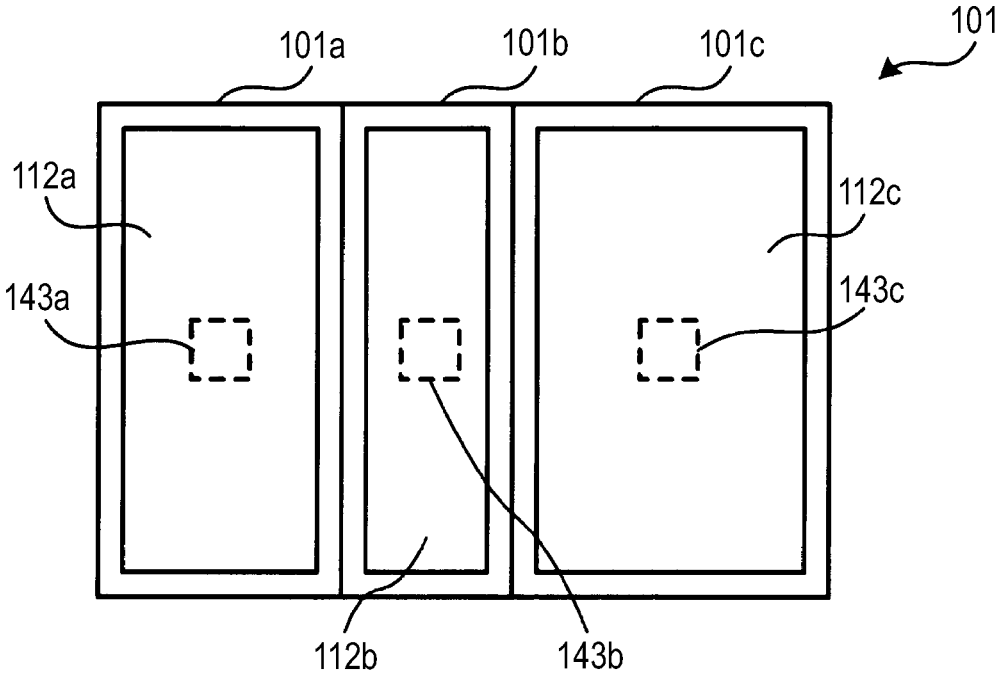

FIGS. 5A and 5B are views illustrating an example of the arrangement of the contact units according to the first embodiment.

For example, in FIG. 5A, a contact unit 141*b* of the contact unit 141*a* to 141*c* of the wiring which supplies electric potential to the respective pixel electrodes 112*a* to 112*c* is misaligned from the pixel electrode 112*b*. In this case, it is difficult to directly connect the contact unit 141*b* to the pixel electrode 112*b*.

On the other hand, in the pixel 101, for the respective sub pixels 101*a* to 101*c*, wiring which is used to supply electric potential to the respective pixel electrodes 112*a* to 112*c* and relay wiring which connects the pixel electrodes 112*a* to 112*c* are formed.

According to this configuration, one end of the relay wiring can be arranged to be connected to the contact units 141*a* to 141*c*, and the other end (contact units 143*a* to 143*c*) can be arranged immediately under the pixel electrodes 112*a* to 112*c* as shown in FIG. 5B. In addition, the pixel electrodes 112*a* to 112*c* are connected to the respective contact units 143*a* to 143*c*, thus it is possible to electrically connect the pixel electrodes 112*a* to 112*c* to the respective contact units 141*a* to 141*c*.

Therefore, in the pixel 101, the arrangement of the pixel electrodes 112*a* to 112*c* is not restricted by the arrangement of the contact units 141*a* to 141*c*. Therefore, it is possible to freely set the area ratio of the respective sub pixels 101*a* to 101*c*.

Second Embodiment

Subsequently, a second embodiment will be described.

Figure 6:
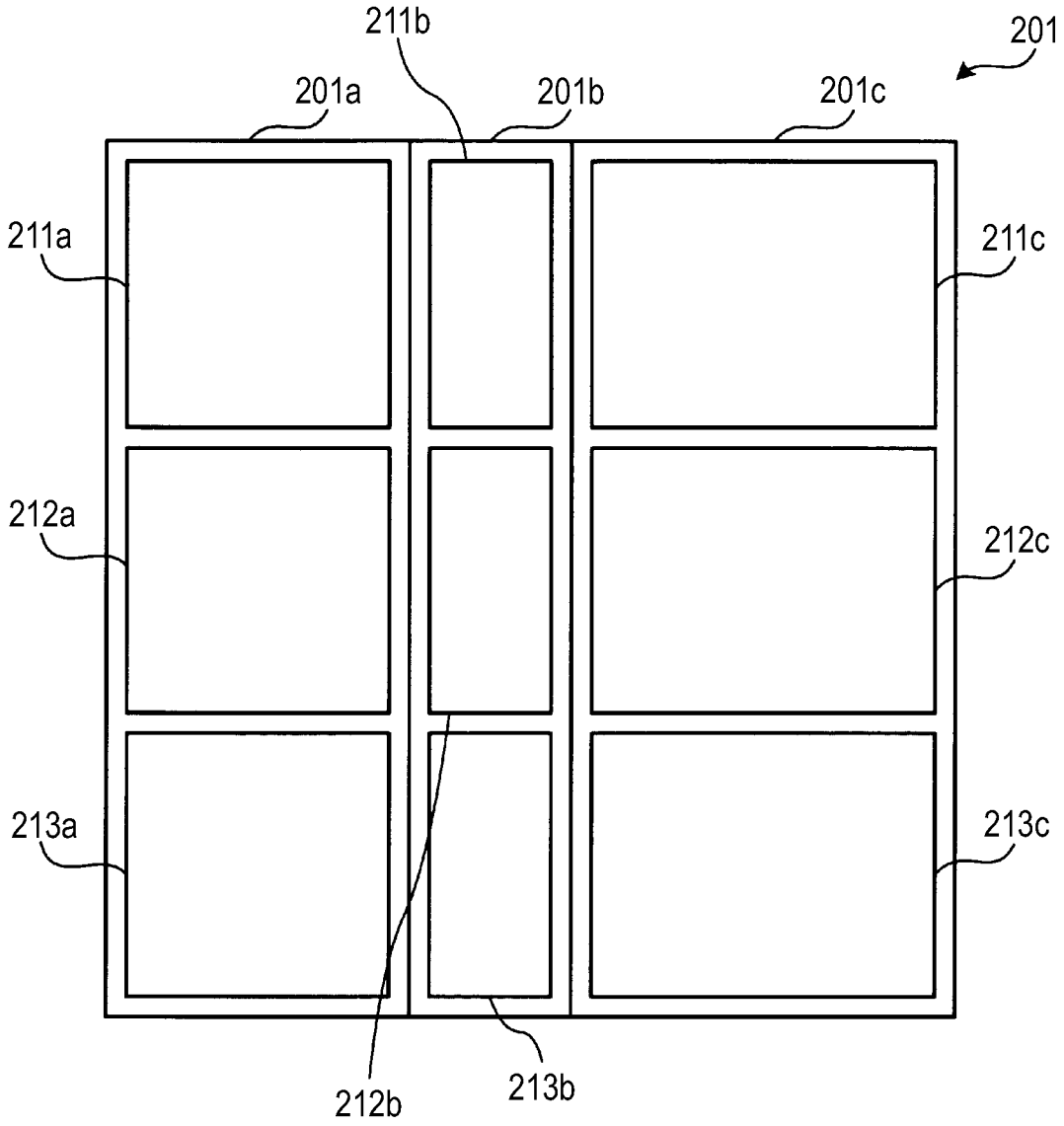
FIG. 6 is a plan view illustrating an example of a pixel according to a second embodiment.

FIG. 6 is a plan view illustrating an example of a pixel according to the second embodiment.

A pixel 201 is different from the pixel 101 according to the first embodiment in that each of the sub pixels includes a plurality of pixel electrodes, and the layout of relay wiring of the pixel 201 is different from that of the pixel 101. Other configurations are the same as those of the pixel 101.

As shown in FIG. 6, the pixel 201 includes a plurality of sub pixels 201*a* to 201*c*. The plurality of sub pixels 201*a* to 201*c* display colors which are different from each other. Here, the sub pixel 201*a* displays red, the sub pixel 201*b* displays green, and the sub pixel 201*c* displays blue.

In addition, the pixel 201 is an atypical pixel, and the sub pixels 201*a* to 201*c* include areas which are different from each other. Here, the magnitude relationship of the areas is that the sub pixel 201*c*>the sub pixel 201*a*>the sub pixel 201*b*. As described above, the areas of the sub pixels 201*a* to 201*c* are differentiated from each other, thus it is possible to adjust white color.

Further, the sub pixels 201*a* to 201*c* include three pixel electrodes 211*a* to 213*a*, 211*b* to 213*b*, and 211*c* to 213*c* respectively. That is, each of the sub pixels 201*a* to 201*c* includes a configuration for displaying area grayscale, which enables the display of grayscale in such a way that the three pixel electrodes are combined.

Subsequently, the sub pixels will be described in detail. Here, the sub pixel 201*a* will be described as a representative of the sub pixels 201*a* to 201*c*. In addition, the sub pixels 201*b* and 201*c* has the same configuration as the sub pixel 201*a*.

Figure 7:
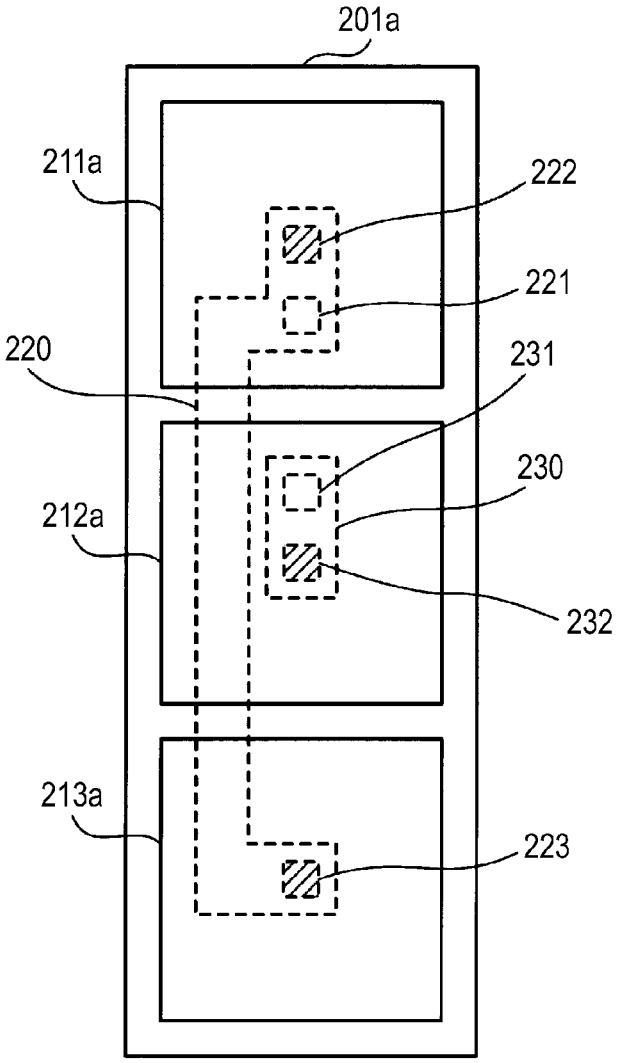
FIG. 7 is a plan view illustrating an example of a sub pixel according to the second embodiment.

FIG. 7 is a plan view illustrating an example of the sub pixel according to the second embodiment.

In the sub pixel 201*a*, relay wiring 220 and 230 are formed. The relay wiring 220 passes under the pixel electrode 212*a* from immediately under the pixel electrode 211*a*, and extends immediately below the pixel electrodes 213*a*. The relay wiring 230 is located immediately under the pixel electrodes 212*a*.

The relay wiring 220 is connected to wiring (not shown) which is used to supply electric potential to the pixel electrodes 211*a* and 213*a* at a contact unit 221, is connected to the pixel electrode 211*a* at a contact unit 222, and is connected to the pixel electrode 213*a* at a contact unit 223. That is, the pixel electrode 211*a* is connected to the pixel electrode 213*a* via the relay wiring 220. The relay wiring 230 is connected to wiring (not shown) which is used to supply electric potential to the pixel electrode 212*a* at a contact unit 231, and is connected to the pixel electrode 212*a* at a contact unit 232.

As described above, since the relay wiring 220 and 230 are formed in the sub pixel 201*a*, it is possible to freely arrange the pixel electrodes 211*a* to 213*a* without being restricted to the locations of the contact units 221 and 231 by drawing the relay wiring 220 and 230.

(Module and Application Example)

Subsequently, an application example of the liquid crystal display apparatus which is described according to the embodiment will be described with reference to FIGS. 8 to 12G. It is possible to apply the liquid crystal display apparatus according to the embodiment to every field of electronic apparatus which displays a video signal which is input from the outside or a video signal which is generated inside as an image or video. Such an electronic apparatus is, for example, a television apparatus, a digital camera, a note-type personal computer, a mobile terminal apparatus such as a mobile phone, a video camera, or the like.

(Application Example 1)

Figure 8:
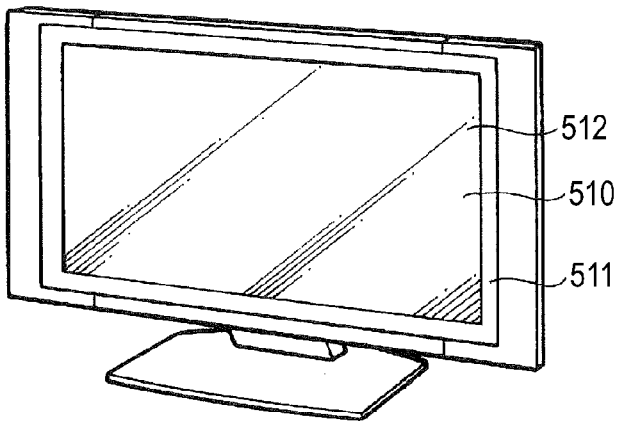
FIG. 8 is a view illustrating an example of the appearance of a television apparatus to which the liquid crystal display apparatus is applied.

FIG. 8 is a view illustrating an example of the appearance of a television apparatus to which the liquid crystal display apparatus is applied. The television apparatus includes a video display screen unit 510 having, for example, a front panel 511 and filter glass 512, and the video display screen unit 510 includes the liquid crystal display apparatus according to the embodiment.

(Application Example 2)

Figure 9A:
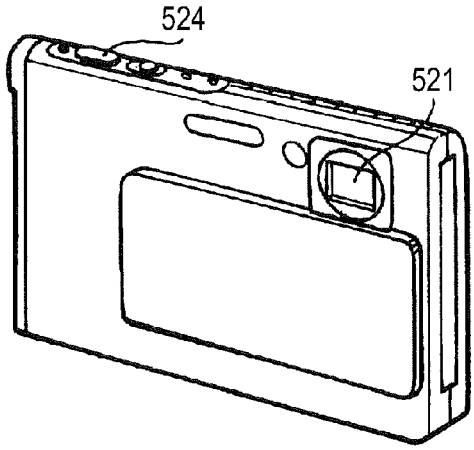
FIGS. 9A and 9B are views illustrating an example of the appearance of a digital camera to which the liquid crystal display apparatus is applied.
Figure 9B:
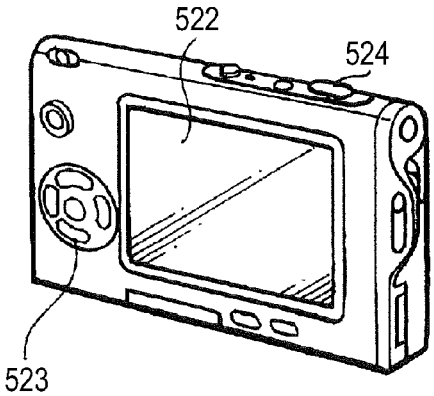

FIGS. 9A and 9B are views illustrating an example of the appearance of a digital camera to which the liquid crystal display apparatus is applied. FIG. 9A is a perspective view which is viewed from a front side, and FIG. 9B is a perspective view which is viewed from a back side. The digital camera includes, for example, a flash-light emitting unit 521, a display unit 522, a menu switch 523, and a shutter button 524, and the display unit 522 includes the liquid crystal display apparatus according to the embodiment.

(Application Example 3)

Figure 10:
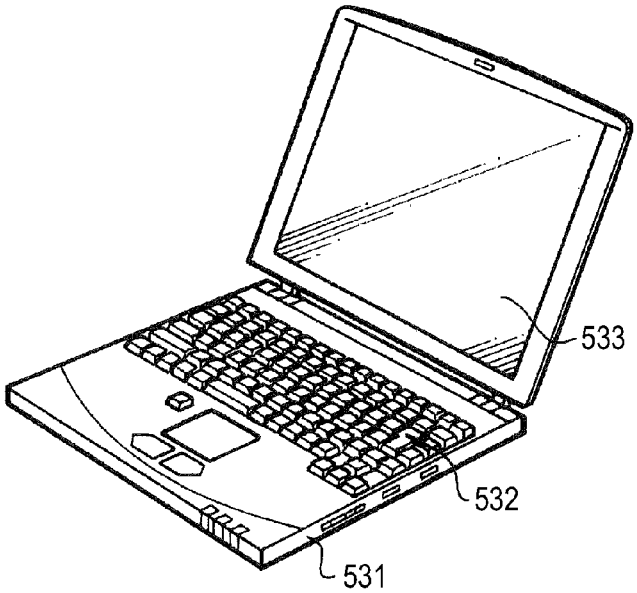
FIG. 10 is a view illustrating an example of the appearance of a note-type personal computer to which the liquid crystal display apparatus is applied.

FIG. 10 is a view illustrating an example of the appearance of a note-type personal computer to which the liquid crystal display apparatus is applied. The note-type personal computer includes, for example, a main body 531, a keyboard 532 which is used to perform input operation for letters or the like, and a display unit 533 which displays an image. The display unit 533 includes the liquid crystal display apparatus according to the embodiment.

(Application Example 4)

Figure 11:
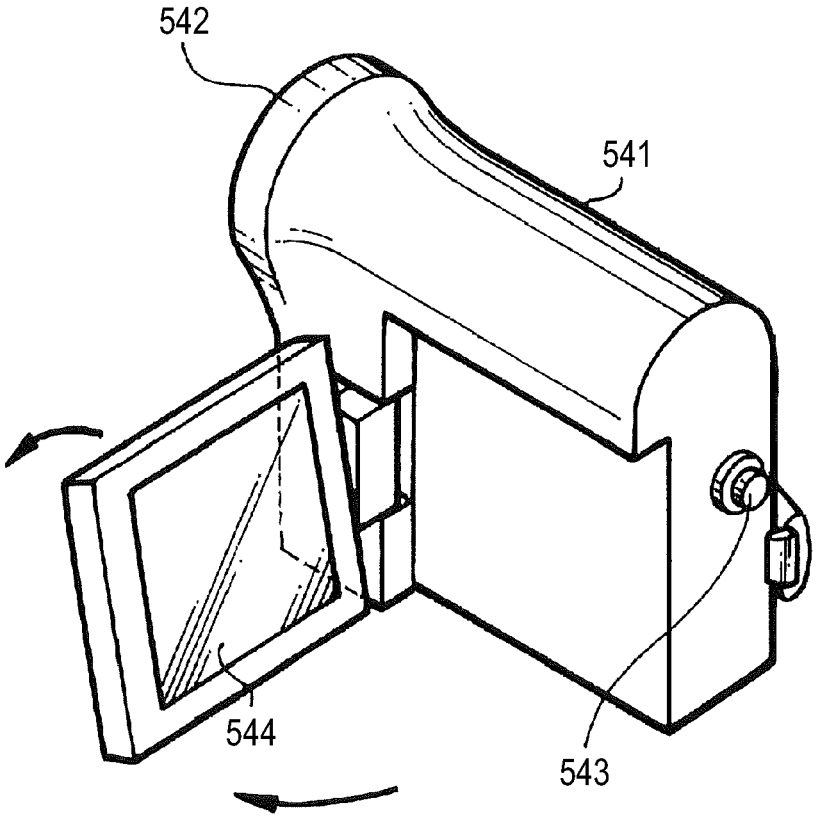
FIG. 11 is a view illustrating an example of the appearance of a video camera to which the liquid crystal display apparatus is applied.

FIG. 11 is a view illustrating an example of the appearance of a video camera to which the liquid crystal display apparatus is applied. The video camera includes, for example, a main body 541, a lens 542 which is provided on the surface of the front side of the main body 541 and which is used to take a photograph of an subject, and a start/stop switch 543 which is used when photographing is performed, and a display unit 544. The display unit 544 includes the liquid crystal display apparatus according to the embodiment.

(Application Example 5)

Figures 12A, 12B:
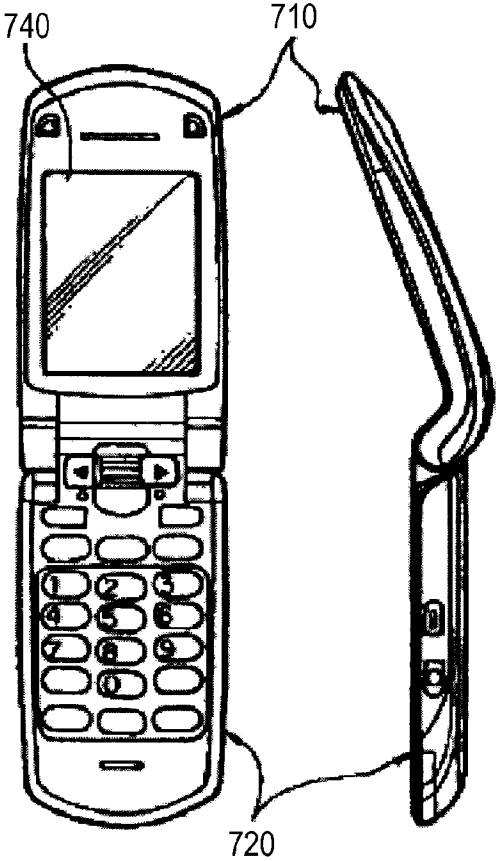
FIGS. 12A to 12G are views illustrating an example of the appearance of a mobile phone to which the liquid crystal display apparatus is applied.
Figure 12F:
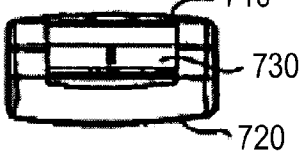
Figure 12C:
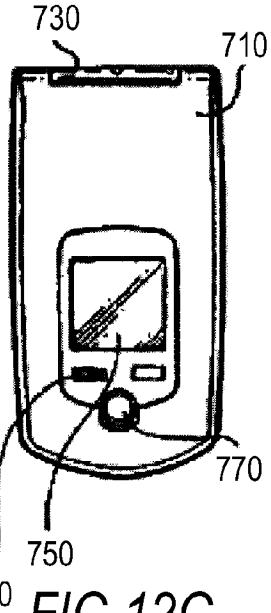
Figure 12E:
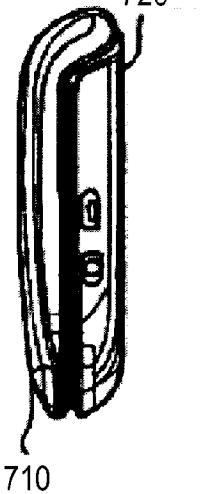
Figure 12D:
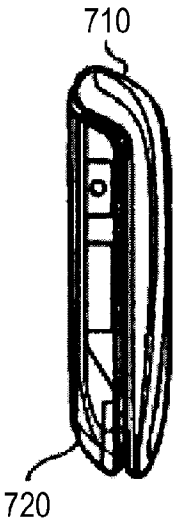
Figure 12G:
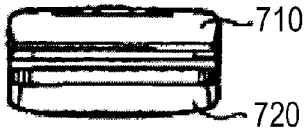

FIGS. 12A to 12G are views illustrating an example of the appearance of a mobile phone to which the liquid crystal display apparatus is applied. FIG. 12A is a front view illustrating a state in which the mobile phone is open, and FIG. 12B is a side view of FIG. 12A. Further, FIG. 12C is a front view illustrating a state in which the mobile phone is closed, FIG. 12D is a left-side view of FIG. 12C, FIG. 12E is a right-side view of FIG. 12C, FIG. 12F is an upper-side view of FIG. 12C, and FIG. 12G is a bottom-side view of FIG. 12C.

The mobile phone connects, for example, an upper-side housing 710 and a bottom-side housing 720 using a connection unit (hinge unit) 730, and includes a display 740, a sub display 750, a picture light 760, and a camera 770. The display 740 and the sub display 750 include the liquid crystal display apparatus according to the embodiment.

In addition, the present disclosure may be implemented as the following configurations.

(1) A display apparatus includes a plurality of sub pixels that are included in a single pixel, that respectively perform a predetermined display based on a voltage which is supplied using a first electrode and a second electrode and display colors which are different from each other. The plurality of sub pixels include areas which are different from each other, and respectively include pixels which have memory properties.

(2) In the display apparatus of (1), each of the plurality of sub pixels includes a storage circuit which stores display data.

(3) The display apparatus of (2) further includes an electric potential line to which predetermined electric potential is supplied. Each of the plurality of sub pixels includes a switch device that controls a conduction state between the electric potential line and the first electrode based on the display data which is stored in the storage circuit.

(4) In the display apparatus of any one of (1) to (3), each of the plurality of sub pixels includes: a substrate; a first wiring that is formed on the substrate, and that supplies electric potential to the first electrode; a first insulation film that is formed on the substrate to cover the first wiring; a second wiring that is formed on the first insulation film, and is connected to the first wiring via a first contact hole which is provided in the first insulation film; and a second insulation film that is formed on the first insulation film to cover the second wiring. The first electrode is formed on the second insulation film, and is connected to the second wiring via a second contact hole which is provided in the second insulation film.

(5) In the display apparatus of (4), the first electrode includes a first electrode unit and a second electrode unit, and the first electrode unit and the second electrode unit are connected to each other using the second wiring.

(6) An electronic apparatus includes a display apparatus that displays an image. The display apparatus includes a plurality of sub pixels that are included in a single pixel, that respectively perform predetermined display based on a voltage which is supplied using a first electrode and a second electrode and display colors which are different from each other. The plurality of sub pixels include areas which are different from each other, and respectively include pixels which have memory properties.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed is:

1. A display apparatus, having pixels each including sub pixels that include an a-subpixel, a b-subpixel adjacent to the a-subpixel, and a c-subpixel adjacent to the b-subpixel, each of the sub pixels performing a predetermined display based on a voltage which is supplied using a first electrode and a second electrode and display colors which are different from each other, wherein each of the sub pixels comprises:

a storage circuit storing display data;

a substrate a first wiring that is formed on the substrate and that supplies electric potential to the first electrode;

a first insulation film that is formed on the substrate to cover the first wiring;

a second wiring that is formed on the first insulation film and that is connected to the first wiring via a first contact hole which is provided in the first insulation film; and a second insulation film that is formed on the first insulation film to cover the second wiring, and wherein the first electrode is formed on the second insulation film and that is connected to the second wiring via a second contact hole which is provided in the second insulation film, wherein among the a-subpixel, the b-subpixel, and the c-subpixel, the b-subpixel has a smallest area, and the c-subpixel has a largest area, wherein for the b-subpixel, the first contact hole overlaps at least a portion of the b-subpixel and the c-subpixel in plan view, and wherein the first contact hole of the b-subpixel is connected to the second contact hole arranged in a center area of the b-subpixel through the second wiring.

2. The display apparatus according to claim 1, further comprising:

an electric potential line to which predetermined electric potential is supplied, wherein each of the sub pixels includes a switch device that controls a conduction state between the electric potential line and the first electrode based on the display data which is stored in the storage circuit.

3. The display apparatus according to claim 1, wherein the first electrode includes a first electrode unit and a second electrode unit, and wherein the first electrode unit and the second electrode unit are connected to each other using the second wiring.

4. The display apparatus according to claim 1, wherein the a-subpixel is configured to emit red light, the b-subpixel is configured to emit green light, and the c-subpixel is configured to emit blue light.

5. An electronic apparatus, having a display apparatus that displays an image, the display apparatus having sub pixels that include an a-subpixel, a b-subpixel adjacent to the a-subpixel, and a c-subpixel adjacent to the b-subpixel, each of the sub pixels performing predetermined display based on a voltage which is supplied using a first electrode and a second electrode and display colors which are different from each other, wherein each of the sub pixels comprises:

a storage circuit storing display data;

a substrate;

a first wiring that is formed on the substrate and that supplies electric potential to the first electrode;

a first insulation film that is formed on the substrate to cover the first wiring;

a second wiring that is formed on the first insulation film and that is connected to the first wiring via a first contact hole which is provided in the first insulation film; and a second insulation film that is formed on the first insulation film to cover the second wiring, and wherein the first electrode is formed on the second insulation film, and is connected to the second wiring via a second contact hole which is provided in the second insulation film, wherein among the a-subpixel, the b-subpixel, and the c-subpixel, the b-subpixel has a smallest area, and the c-subpixel has a largest area, wherein the b-subpixel, the first contact hole overlaps at least a portion of the b-subpixel and the c-subpixel in plan view, and wherein the first contact hold of the b-subpixel is connected to the second contact hole arranged in a center area of the b-subpixel through the second wiring.

* * * * *